US010663880B2

(12) United States Patent
Tsuda

(10) Patent No.: US 10,663,880 B2
(45) Date of Patent: May 26, 2020

(54) CHARGING DEVICE AND IMAGE FORMING APPARATUS

(71) Applicant: FUJI XEROX CO., LTD., Tokyo (JP)

(72) Inventor: Yu Tsuda, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/275,915

(22) Filed: Feb. 14, 2019

(65) Prior Publication Data

US 2020/0096894 A1 Mar. 26, 2020

(30) Foreign Application Priority Data

Sep. 25, 2018 (JP) ..... 2018-178267

(51) Int. Cl.
*G03G 15/02* (2006.01)

(52) U.S. Cl.
CPC ..... *G03G 15/0291* (2013.01)

(58) Field of Classification Search
CPC ..... G03G 15/02; G03G 15/0291; G03G 2215/026; G03G 2215/027
See application file for complete search history.

(56) References Cited

U.S. PATENT DOCUMENTS 5,485,255 A * 1/1996 Reuschle ..... G03G 15/0258 250/325
7,043,176 B1 * 5/2006 DeHollander ..... G03G 15/0291 399/170

FOREIGN PATENT DOCUMENTS

| | | | |
|---|---|---|---|
| JP | 06-242661 A | | 9/1994 |
| JP | 08262839 A | * | 10/1996 |
| JP | 2004-027505 A | | 1/2004 |
| JP | 2008116724 A | * | 5/2008 |
| JP | 2013064788 A | * | 4/2013 |

OTHER PUBLICATIONS

JP 08262839 English machine translation, Ogiyama et al., Oct. 11, 1996 (Year: 1996).*
JP 2013064788 English machine translation, Sasaki, Apr. 11, 2013 (Year: 2013).*

* cited by examiner

*Primary Examiner* — Thomas S Giampaolo, II
(74) *Attorney, Agent, or Firm* — Sughrue Mion, PLLC

(57) ABSTRACT

A charging device includes a housing, a corona wire stretched in the housing, and a positioning member supporting the corona wire and determining a distance between the corona wire and a photoconductor, the positioning member being provided at an end of the housing. The positioning member has a vertex extending in a direction intersecting a corona-wire-stretching direction in which the corona wire is stretched. An elastic member is provided in a gap between the positioning member and the corona wire supported at the vertex, the gap spreading in the corona-wire-stretching direction.

20 Claims, 9 Drawing Sheets

CHARGING DEVICE AND IMAGE FORMING APPARATUS

CROSS-REFERENCE TO RELATED APPLICATIONS

This application is based on and claims priority under 35 USC 119 from Japanese Patent Application No. 2018-178267 filed Sep. 25, 2018.

BACKGROUND

(i) Technical Field

The present disclosure relates to a charging device and an image forming apparatus.

(ii) Related Art

There is a known corona discharge device that causes corona discharge by applying a voltage to a corona discharge wire and includes a vibration absorbing member. The vibration absorbing member is elastic and is provided on the corona discharge wire (see Japanese Unexamined Patent Application Publication No. 6-242661).

There is a known shock damping structure that is interposed between and absorbs the impact of collision between two self-supporting structural bodies that are spaced apart from each other but may interfere with each other if swung with respect to each other. The shock damping structure includes a shock damping device provided on one of the two structural bodies and exerting a shock damping effect in a lateral direction, a contact body provided on the other of the two structural bodies and including a counter portion that faces the shock damping device with a gap therebetween in the direction in which the shock damping device exerts the shock damping effect, and a low-elasticity member having a low elastic modulus and provided in the gap between the shock damping device and the counter portion in such a manner as to be compressed therebetween (see Japanese Unexamined Patent Application Publication No. 2004-27505).

SUMMARY

Aspects of non-limiting embodiments of the present disclosure relate to a charging device and an image forming apparatus in each of which the vibration of a corona wire is suppressed, whereby the occurrence of an image defect is suppressed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a charging device including a housing, a corona wire stretched in the housing, and a positioning member supporting the corona wire and determining a distance between the corona wire and a photoconductor, the positioning member being provided at an end of the housing. The positioning member has a vertex extending in a direction intersecting a corona-wire-stretching direction in which the corona wire is stretched. An elastic member is provided in a gap between the positioning member and the corona wire supported at the vertex, the gap spreading in the corona-wire-stretching direction.

BRIEF DESCRIPTION OF THE DRAWINGS

Exemplary embodiments of the present disclosure will be described in detail based on the following figures, wherein.

DETAILED DESCRIPTION

The present disclosure will now be described in detail with some exemplary embodiments and specific examples and with reference to the drawings. Note that the present disclosure is not limited to the following exemplary embodiments and specific examples.

The drawings to be referred to in the following description are only schematic, and it should be noted that elements illustrated therein are not necessarily to scale. For easy understanding, some irrelevant elements are not illustrated.

Figure 1:
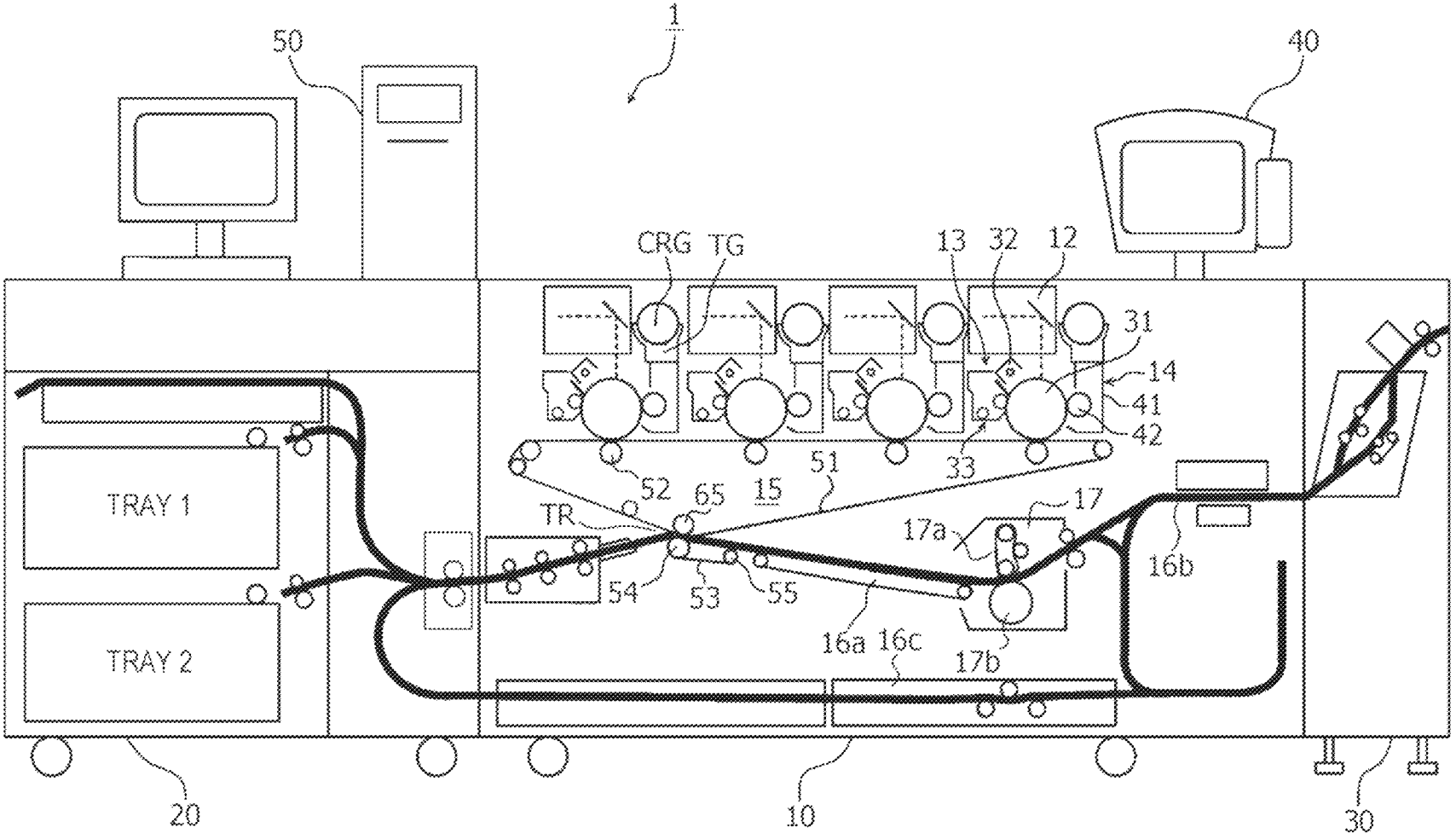
FIG. 1 is a schematic sectional view illustrating an outline configuration of an image forming apparatus.
Figure 2:
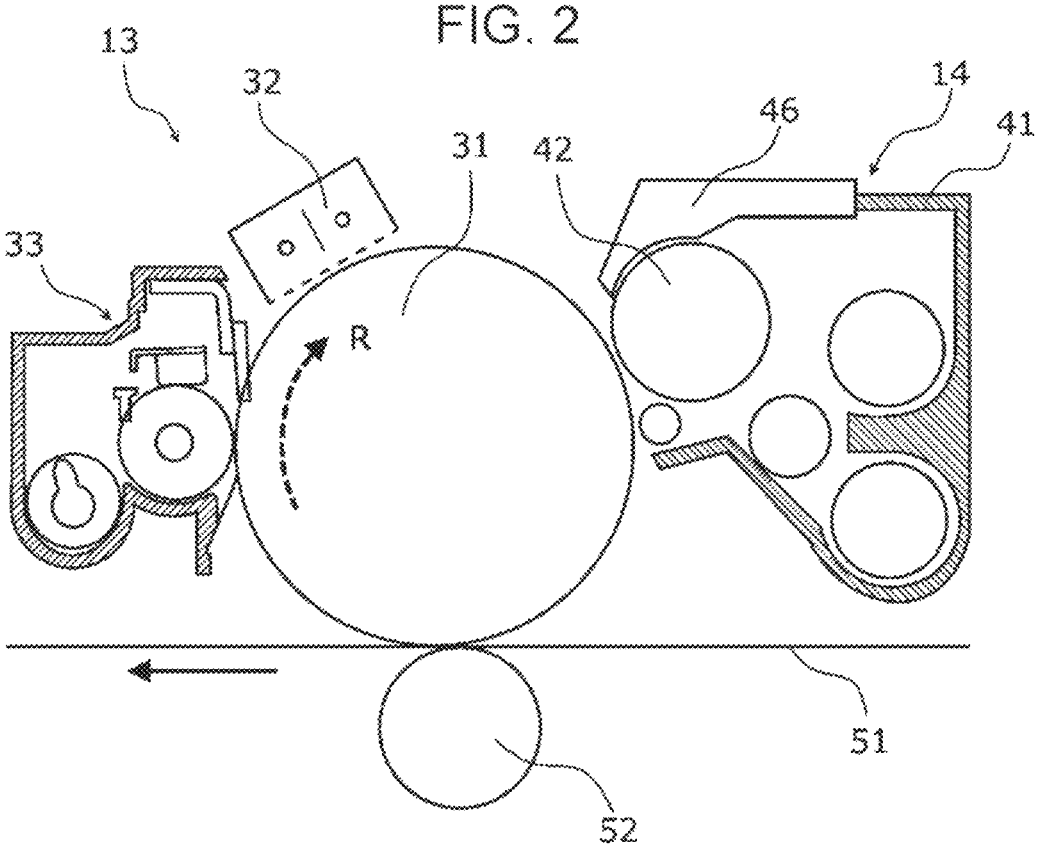
FIG. 2 is a vertical sectional view illustrating a photoconductor unit and a developing device.

(1) Overall Configuration and Operation of Image Forming Apparatus (1.1) Overall Configuration of Image Forming Apparatus FIG. 1 is a schematic sectional view illustrating an outline configuration of an image forming apparatus 1 according to a first exemplary embodiment. FIG. 2 is a vertical sectional view illustrating a photoconductor unit 13 and a developing device 14.

The image forming apparatus 1 includes an image forming section 10, a sheet feeding device 20 attached to one end of the image forming section 10, a sheet outputting section 30 attached to the other end of the image forming section 10 and from which printed sheets are outputted, an operation-display unit 40, and an image processing unit 50 that generates image information from printing information transmitted thereto from a host device.

The image forming section 10 includes a system control device 11 (not illustrated), exposure devices 12, photoconductor units 13, developing devices 14, a transfer device 15, sheet transport devices 16*a* to 16*c*, a fixing device 17, and a driving device 18 (not illustrated). The image forming section 10 receives a sheet from the sheet feeding device 20 and forms a toner image on the sheet in accordance with the image information received from the image processing unit 50.

The sheet feeding device 20 feeds sheets to the image forming section 10. Specifically, the sheet feeding device 20 includes a plurality of sheet stacking units provided for different kinds (different materials, thicknesses, sizes, textures, and so forth) of sheets. The sheet feeding device 20 feeds sheets one by one from any of the plurality of sheet stacking units to the image forming section 10.

The sheet outputting section 30 outputs the sheet having an image formed thereon by the image forming section 10. Therefore, the sheet outputting section 30 includes a sheet receiving portion that receives the sheet having the image. The sheet outputting section 30 may have a function of performing aftertreatment, such as cutting or stapling, on a set of sheets outputted from the image forming section 10.

The operation display unit 40 is used for making various settings and instructions and for displaying such pieces of information. The operation display unit 40 corresponds to a so-called user interface. Specifically, the operation display unit 40 is a combination of a liquid-crystal display panel, various operation buttons, a touch panel, and so forth.

(1.2) Configuration and Operation of Image Forming Section

In the image forming apparatus 1 configured as above, a sheet picked up from one of the sheet stacking units of the sheet feeding device 20 that is designated for each page of a print job is fed into the image forming section 10 in accordance with the timing of image formation.

The photoconductor units 13 are arranged in parallel and below the respective exposure devices 12. The photoconductor units 13 each include a photoconductor drum 31 that rotates when driven. The photoconductor drum 31 serves as an image carrier. The photoconductor drum 31 is surrounded, in order in the direction of rotation of the photoconductor drum 31, by a charging device 32, the exposure device 12, the developing device 14, a first transfer roller 52, and a cleaning device 33.

The developing device 14 includes a development housing 41 that stores developer thereinside. The development housing 41 houses a developing roller 42 positioned in such a manner as to face the photoconductor drum 31. The development housing 41 is provided with a trimmer 46 (see FIG. 2) positioned in proximity to the developing roller 42. The trimmer 46 regulates the thickness of a developer layer.

All the developing devices 14 have substantially the same configuration, except the color of the developer stored in the respective development housings 41. The developing devices 14 form toner images in the colors of yellow (Y), magenta (M), cyan (C), and black (K), respectively.

The image forming section 10 further includes exchangeable toner cartridges CRG and toner cartridge guides TG both provided above the respective developing devices 14. The toner cartridges CRG each store the developer (containing carrier and toner). The toner cartridge guides TG guide the insertion and removal of the respective toner cartridges CRG and supply the developers from the toner cartridges CRG to the developing devices 14, respectively.

The charging devices 32 charge the surfaces of the respective photoconductor drums 31 that are rotating. The exposure devices 12 apply latent-image-forming beams to the respective photoconductor drums 31, thereby forming electrostatic latent images thereon, respectively. The electrostatic latent images thus formed on the photoconductor drums 31 are developed into toner images by the developing rollers 42, respectively.

The transfer device 15 includes an intermediate transfer belt 51 that is an endless member and to which the toner images in the respective colors formed on the photoconductor drums 31 of the respective photoconductor units 13 are transferred one on top of another. The transfer device 15 further includes the first transfer rollers 52 with which the toner images in the respective colors formed by the respective photoconductor units 13 are sequentially transferred (first transfer) to the intermediate transfer belt 51, and a second transfer belt 53 with which the toner images in the respective colors superposed one on top of another on the intermediate transfer belt 51 are collectively transferred (second transfer) to a sheet as a recording medium.

The second transfer belt 53 is stretched between a second transfer roller 54 and a release roller 55 and is nipped between a backup roller 65 provided on the back side of the intermediate transfer belt 51 and the second transfer roller 54, thereby forming a second transfer part TR.

The toner images in the respective colors formed on the photoconductor drums 31 of the respective photoconductor units 13 are sequentially electrostatically transferred (first transfer) to the intermediate transfer belt 51 by the respective first transfer rollers 52 to which a predetermined transfer voltage is applied from a power supply device or the like (not illustrated) controlled by the system control device 11. Thus, a toner-image superposition composed of the toner images in the respective colors that are superposed one on top of another is formed.

With the rotation of the intermediate transfer belt 51, the toner-image superposition on the intermediate transfer belt 51 is transported to the second transfer part TR, where the second transfer belt 53 is provided. In accordance with the timing of the toner-image superposition reaching the second transfer part TR, a sheet is fed to the second transfer part TR from the sheet feeding device 20. Meanwhile, the power supply device or the like controlled by the system control device 11 applies a predetermined transfer voltage to the backup roller 65 that faces the second transfer roller 54 with the second transfer belt 53 interposed therebetween, whereby the toner-image superposition on the intermediate transfer belt 51 is transferred to the sheet.

Some toner particles remaining on the surfaces of the photoconductor drums 31 are removed by the respective cleaning devices 33 and are collected in a waste-toner storage (not illustrated). The surfaces of the photoconductor drums 31 are then recharged by the respective charging devices 32.

The fixing device 17 includes an endless fixing belt 17*a* that rotates in one direction, and a pressure roller 17*b* that is in contact with the peripheral surface of the fixing belt 17*a* and rotates in one direction. An area where the fixing belt 17*a* and the pressure roller 17*b* are pressed against each other forms a nip part (a fixing area).

The sheet having the toner-image superposition transferred thereto by the transfer device 15 but not being fixed yet is transported to the fixing device 17 by the sheet transport device 16*a*. The sheet thus reached the fixing device 17 is pressed and heated between the fixing belt 17*a* and the pressure roller 17*b*, whereby the toner-image superposition is fixed.

The sheet having undergone the fixing is transported by the sheet transport device 16*b* into the sheet outputting section 30.

If another image is to be formed on the other side of the sheet, the sheet is turned over by the sheet transport device 16*c* and is fed into the second transfer part TR of the image forming section 10 again. Then, after the transfer and the fixing of another set of toner images are done, the sheet is transported into the sheet outputting section 30. The sheet thus reached the sheet outputting section 30 undergoes aftertreatment such as cutting or stapling, according to need, and is outputted to the sheet receiving portion.

(2) Charging Device

Figure 3:
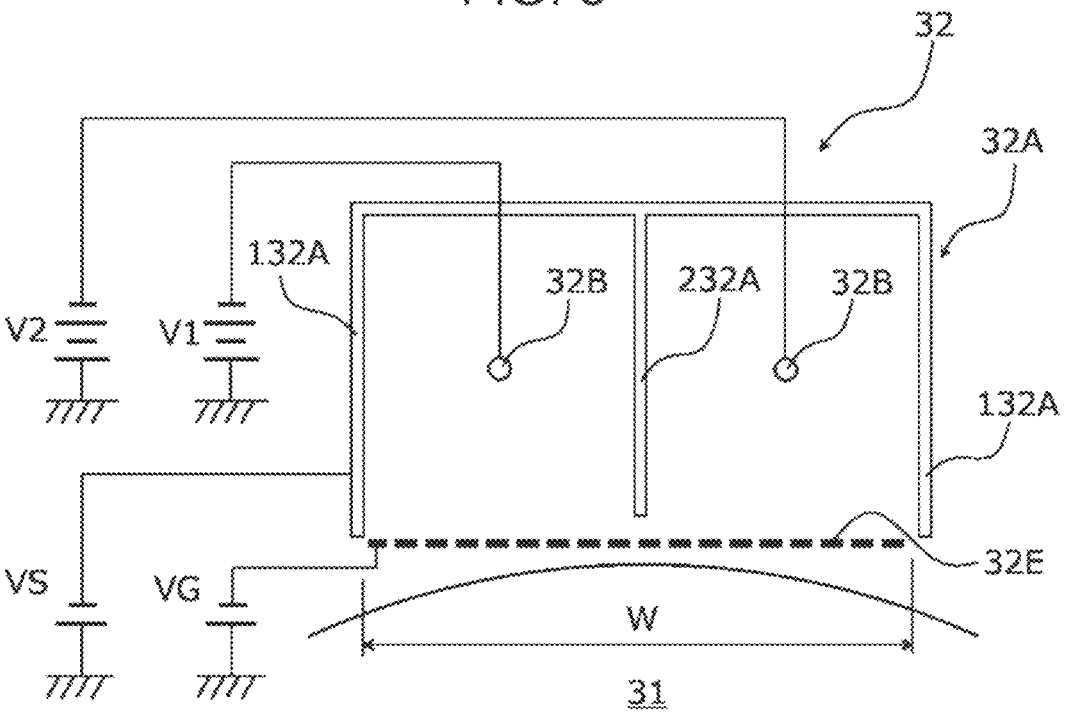
FIG. 3 is a schematic sectional view illustrating how a voltage is applied to a charging device.
Figure 4:
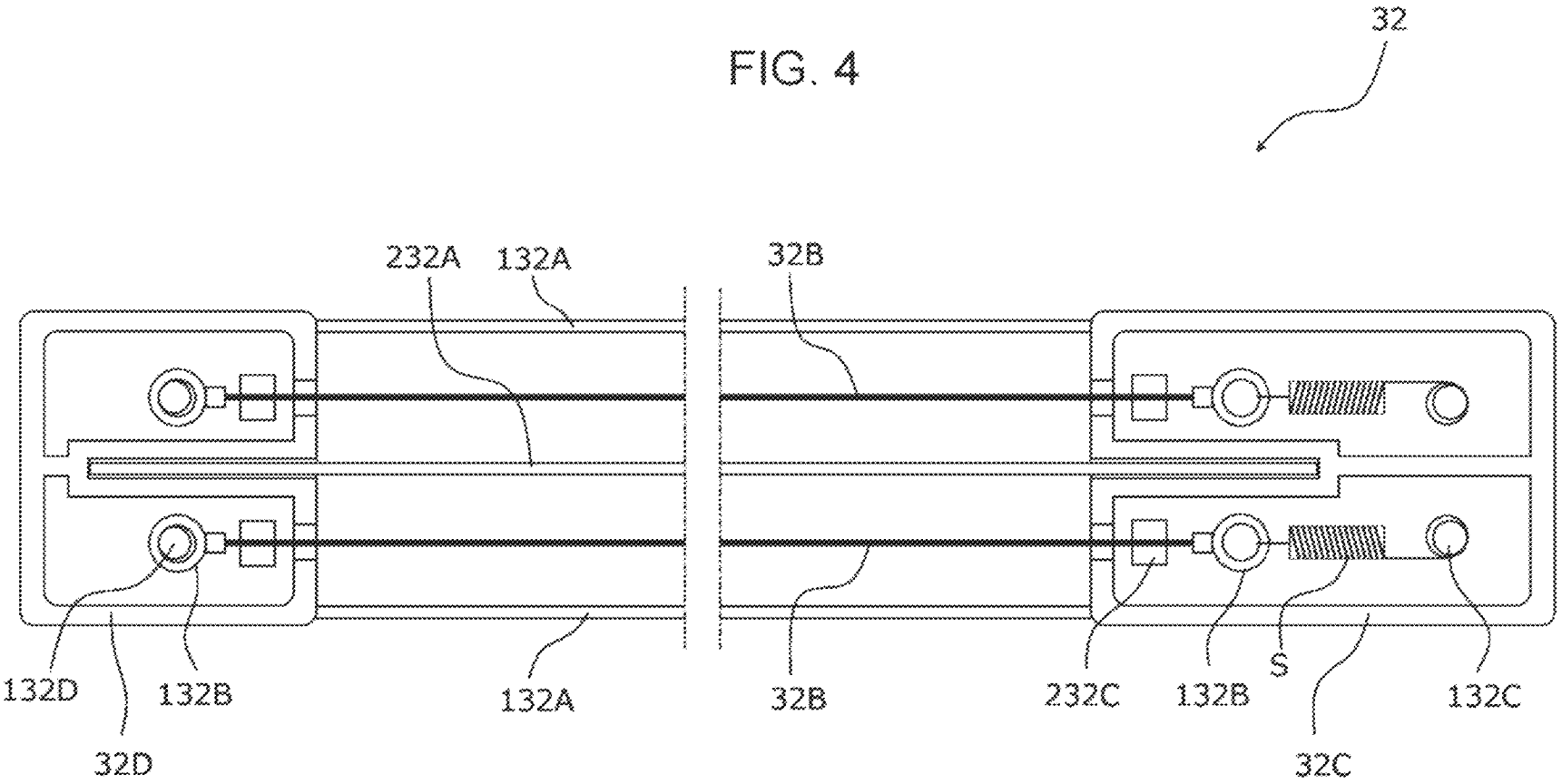
FIG. 4 illustrates a configuration of the charging device in a corona-wire-stretching direction, with a grid electrode not illustrated.
Figure 5:
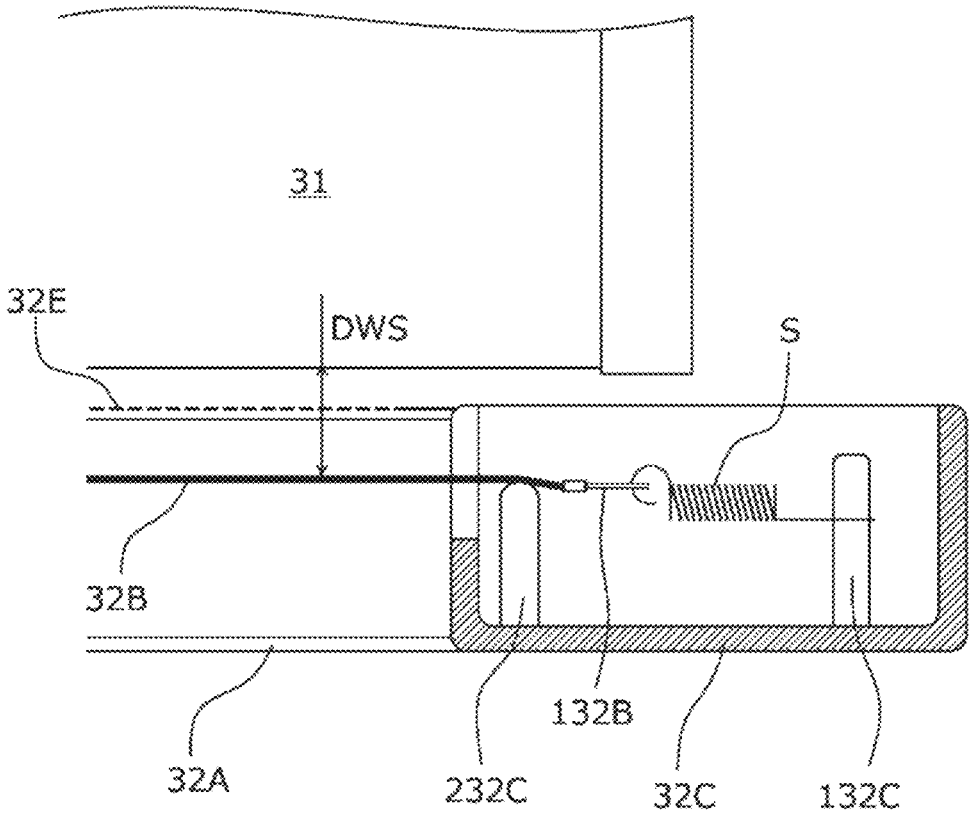
FIG. 5 is a schematic sectional view illustrating a configuration of stretching a corona wire in the charging device according to a first exemplary embodiment.
Figure 6A:
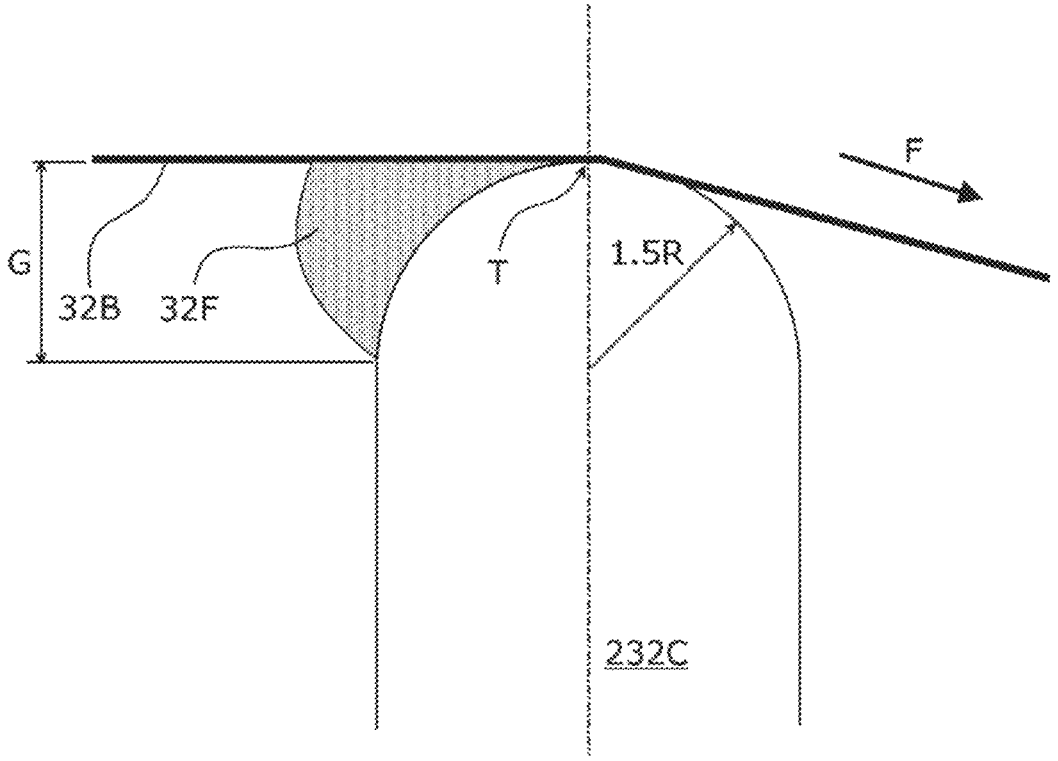
FIGS. 6A and 6B are schematic sectional views illustrating the corona wire stretched in the charging device.
Figure 6B:
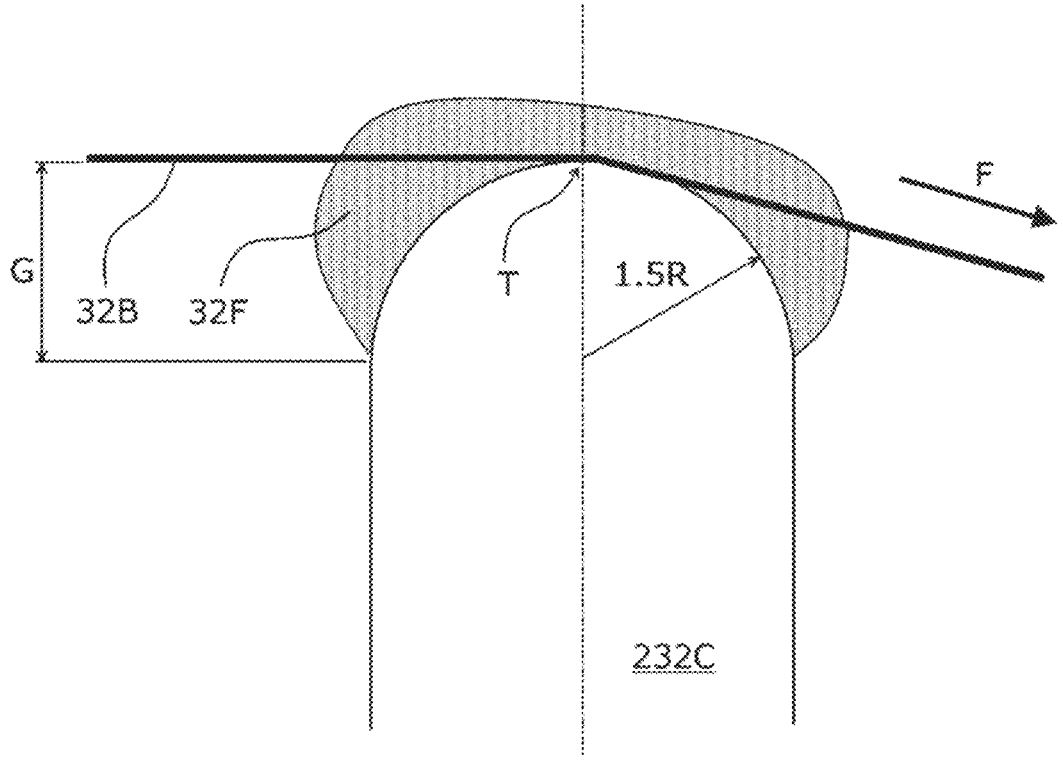
Figure 10:
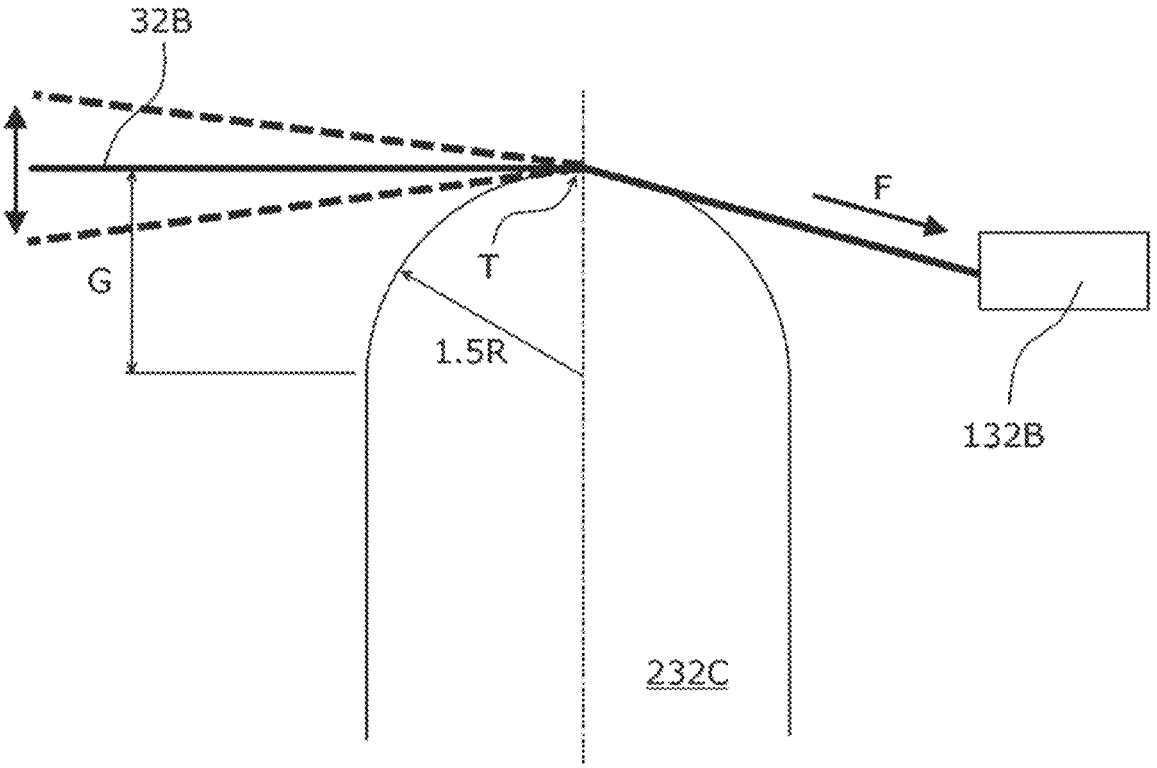
FIG. 10 is a schematic sectional view illustrating how the corona wire vibrates.

FIG. 3 is a schematic sectional view illustrating how a voltage is applied to the charging device 32. FIG. 4 illustrates a configuration of the charging device 32 in a corona-wire-stretching direction, with a grid electrode 32E not illustrated. FIG. 5 is a schematic sectional view illustrating a configuration of stretching a corona wire 32B in the charging device 32. FIGS. 6A and 6B are schematic sectional views illustrating the corona wire 32B stretched in the charging device 32. FIG. 10 is a schematic sectional view illustrating how the corona wire 32B vibrates.

The configuration and the operation of the charging device 32 will now be described with reference to the drawings.

(2.1) Overall Configuration of Charging Device

The charging device 32 is exchangeably provided on the downstream side with respect to the cleaning device 33 in the direction of rotation of the photoconductor drum 31 (a direction of arrow R illustrated in FIG. 2).

Referring to FIG. 3, the charging device 32 includes an aluminum shielding case 32A as an exemplary housing. A side of the shielding case 32A that faces the photoconductor drum 31 is open. The shielding case 32A according to the first exemplary embodiment has an opening width W of about 30 mm (the opening width W, denoted in FIG. 3, refers to the size of the opening provided in an area facing the photoconductor drum 31 and in the direction of rotation of the photoconductor drum 31).

Referring to FIG. 4, the shielding case 32A has a long narrow box-like shape extending parallel to the axis of rotation of the photoconductor drum 31 and includes side shields 132A forming a pair of sidewalls each extending in the long-side direction thereof. The shielding case 32A further includes a center shield 232A between the pair of side shields 132A. The center shield 232A extends parallel to the side shields 132A and divides the inside of the shielding case 32A into two spaces.

The shielding case 32A is connected to a power source VS. A constant voltage (in the first exemplary embodiment, −700 V) is applied to the shielding case 32A.

In the shielding case 32A, two corona wires 32B (in the first exemplary embodiment, each having a diameter of 60 μm) are stretched on two respective sides of the center shield 232A. The corona wires 32B serve as discharge electrodes made of tungsten wire. Two ends of each of the corona wires 32B are supported by insulating blocks 32C and 32D, respectively. The insulating blocks 32C and 32D are electrically insulated from the shielding case 32A.

The corona wires 32B each extend parallel to the axis of rotation of the photoconductor drum 31. The corona wires 32B are connected to high-voltage power supplies V1 and V2, respectively, and are under constant current control such that the current supplied thereto is constant (in the first exemplary embodiment, −800 μA×2). Hence, the corona wires 32B each generate a negative charge and supply a corona ion current to the photoconductor drum 31, which is an object of charging.

The shielding case 32A is provided with the grid electrode 32E on the open side thereof. The grid electrode 32E extends in the long-side direction of the shielding case 32A and between the corona wire 32B and the photoconductor drum 31. The grid electrode 32E has a predetermined grid-like opening pattern.

The grid electrode 32E is positioned at a constant distance from the photoconductor drum 31. The grid electrode 32E is connected to a power supply VG, whereby a constant voltage (in the first exemplary embodiment, −700 V) that is equal to a preset potential for charging the photoconductor drum 31 (a charging potential that is set before exposure) is applied to the grid electrode 32E.

(2.2) Stretching Corona Wire

Referring to FIG. 4, the corona wires 32B each have hook members 132B at the two respective ends thereof. The hook member 132B at one end of each corona wire 32B is attached to a boss 132D standing in the insulating block 32D. The hook member 132B at the other end of each corona wire 32B is attached to an extension spring S attached to a boss 132C standing in the insulating block 32C.

Thus, the corona wires 32B are each stretched under a predetermined tension F in the long-side direction of the shielding case 32A. The corona wires 32B each cause corona discharge in the shielding case 32A when a high voltage is applied thereto from a corresponding one of the high-voltage power supplies V1 and V2.

Referring to FIG. 5, each corona wire 32B is supported by a positioning portion 232C standing in the insulating block 32C, thereby being held at a predetermined distance (denoted in FIG. 5 as DWS, which stands for "drum-to-wire space") from the photoconductor drum 31.

Referring to FIGS. 6A and 6B, the positioning portion 232C has a curved top surface (in the first exemplary embodiment, with a curvature of 1.5R) in sectional view taken in a corona-wire-stretching direction in which the corona wire 32B is stretched, and a vertex T of the top surface extends in a direction intersecting (orthogonal to) the corona-wire-stretching direction and is at the center of the top surface in the corona-wire-stretching direction. The corona wire 32B that is in contact with the vertex T is stretched under the tension F generated by the extension spring S, thereby being held at the predetermined distance DWS from the photoconductor drum 31.

In the charging device 32 configured as above, when corona discharge is caused with a high-voltage power supplied to the corona wire 32B stretched under the predetermined tension F, referring to FIG. 10, the corona wire 32B supported at the vertex T of the positioning portion 232C vibrates vertically (as represented by the double-headed arrow in FIG. 10) in a gap G produced between the positioning portion 232C and the corona wire 32B and spreading in the corona-wire-stretching direction. Such a situation may make the potential for charging the photoconductor drum 31 nonuniform. Consequently, an image defect may occur.

If such vibration of the corona wire 32B is suppressed by increasing the tension F generated by the extension spring S, the corona wire 32B may be broken.

(2.3) Elastic Member

In the charging device 32 according to the first exemplary embodiment illustrated in FIGS. 6A and 6B, the positioning portion 232C has the curved top surface in sectional view taken in the corona-wire-stretching direction, and the vertex T of the top surface extends in the direction intersecting (orthogonal to) the corona-wire-stretching direction. Furthermore, an elastic member 32F is provided in such a manner as to fill the gap G produced between the positioning portion 232C and the corona wire 32B supported at the vertex T of the positioning portion 232C, the gap G spreading in the corona-wire-stretching direction.

The material for the elastic member 32F is not specifically limited, as long as the material is elastic and is capable of absorbing vibration, and may be a silicone resin material or a rubber material. Specifically, the silicone resin material may be methyl silicone rubber or the like. The rubber material may be synthetic rubber such as nitrile-butadiene rubber (NBR), silicone rubber, or fluorocarbon rubber (FPM); or a rubber-like elastic material such as thermoplastic elastomer obtained by mixing polypropylene (PP) and ethylene propylene rubber (EPDM). The rubber-like elastic material may be a mixture of a plurality of synthetic rubbers, or a material containing natural rubber.

The elastic member 32F illustrated in FIG. 6A is obtained by applying the above material in such a manner as to fill the gap G between the positioning portion 232C and the corona wire 32B supported at the vertex T of the positioning portion 232C, and drying the material. Thus, the gap G is assuredly filled with the elastic member 32F. Hence, the vibration of the corona wire 32B is suppressed. Consequently, the occurrence of an image defect is suppressed.

Alternatively, referring to FIG. 6B, the elastic member 32F may be provided over the corona wire 32B supported at the vertex T of the positioning portion 232C, in such a manner as to cover the top surface of the positioning portion 232C. Thus, even if the corona wire 32B is broken, the corona wire 32B is retained and is prevented from being taken into the shielding case 32A.

First Modification

Figure 7A:
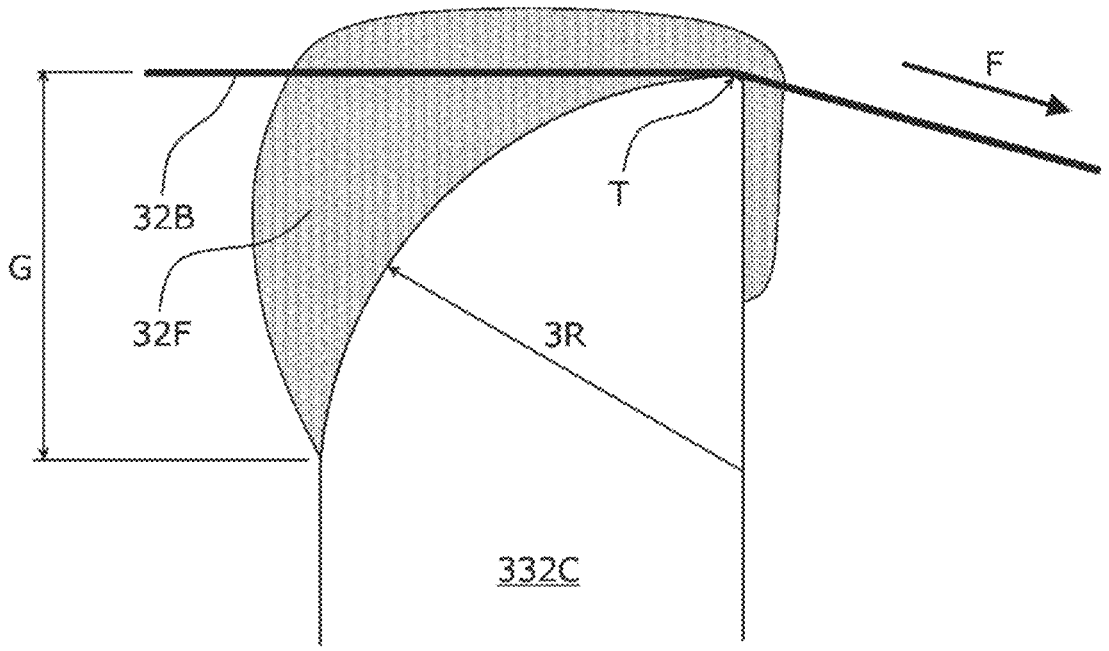
FIG. 7A is a schematic sectional view illustrating a corona wire stretched in a charging device according to a first modification.

FIG. 7A is a schematic sectional view illustrating the corona wire 32B stretched in a charging device 32 according to a first modification.

In the charging device 32 according to the first modification illustrated in FIG. 7A, a positioning portion 332C provided in the insulating block 32C and supporting the corona wire 32B in a stretched state has a curved top surface in sectional view taken in the corona-wire-stretching direction. Furthermore, a vertex T of the top surface extends in a direction intersecting (orthogonal to) the corona-wire-stretching direction and is at an end of the top surface that is on the proximal side in the corona-wire-stretching direction.

Therefore, in the state illustrated in FIG. 7A where the corona wire 32B is supported at the vertex T of the positioning portion 332C, the gap G between the positioning portion 332C and the corona wire 32B is greater than in the case of the positioning portion 232C. In the first modification, if the elastic member 32F is provided in such a manner as to fill the gap G between the positioning portion 332C and the corona wire 32B, the area of the positioning portion 332C that is covered by the elastic member 32F is greater than in the case of the positioning portion 232C. Therefore, the vibration of the corona wire 32B is suppressed more assuredly.

Second Modification

Figure 7B:
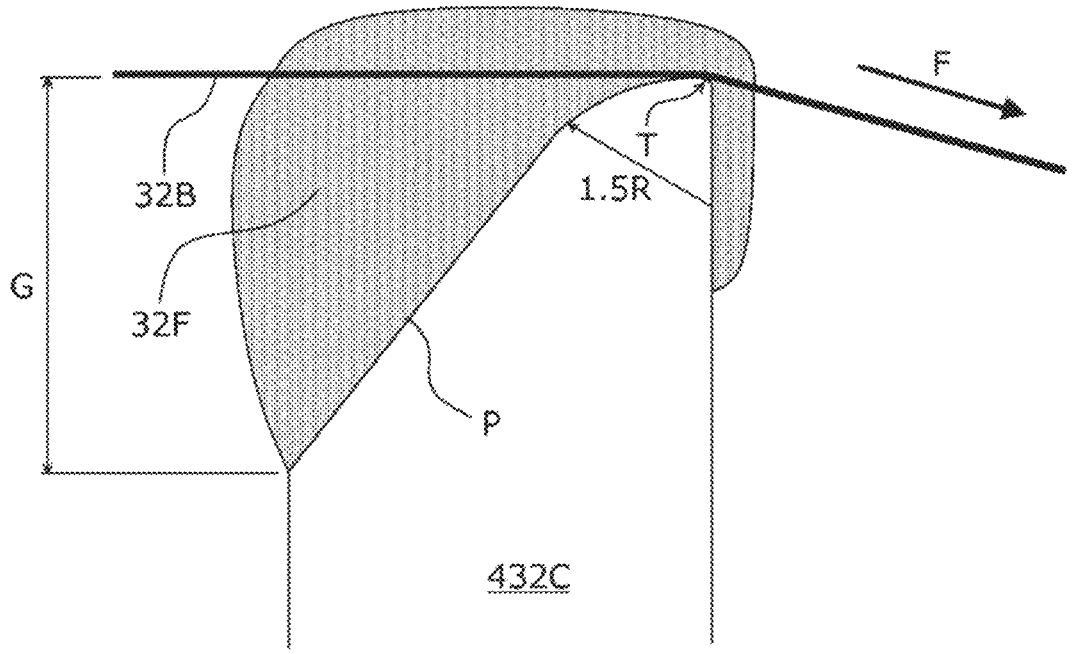
FIG. 7B is a schematic sectional view illustrating a corona wire stretched in a charging device according to a second modification.

FIG. 7B is a schematic sectional view illustrating the corona wire 32B stretched in a charging device 32 according to a second modification.

In the charging device 32 according to the second modification illustrated in FIG. 7B, a positioning portion 432C provided in the insulating block 32C and supporting the corona wire 32B in a stretched state has a top surface including a curved portion and a vertically inclined portion P in sectional view taken in the corona-wire-stretching direction. Furthermore, a vertex T of the top surface extends in a direction intersecting (orthogonal to) the corona-wire-stretching direction and is at an end of the top surface that is on the proximal side in the corona-wire-stretching direction.

Therefore, in the state illustrated in FIG. 7B where the corona wire 32B is supported at the vertex T of the positioning portion 432C, the gap G between the positioning portion 432C and the corona wire 32B is greater than in the case of the positioning portion 232C. In the second modification, if the elastic member 32F is provided in such a manner as to fill the gap G between the positioning portion 432C and the corona wire 32B, the area of the positioning portion 432C that is covered by the elastic member 32F is greater than in the case of the positioning portion 232C. Therefore, the vibration of the corona wire 32B is suppressed more assuredly.

Second Exemplary Embodiment

Figure 8A:
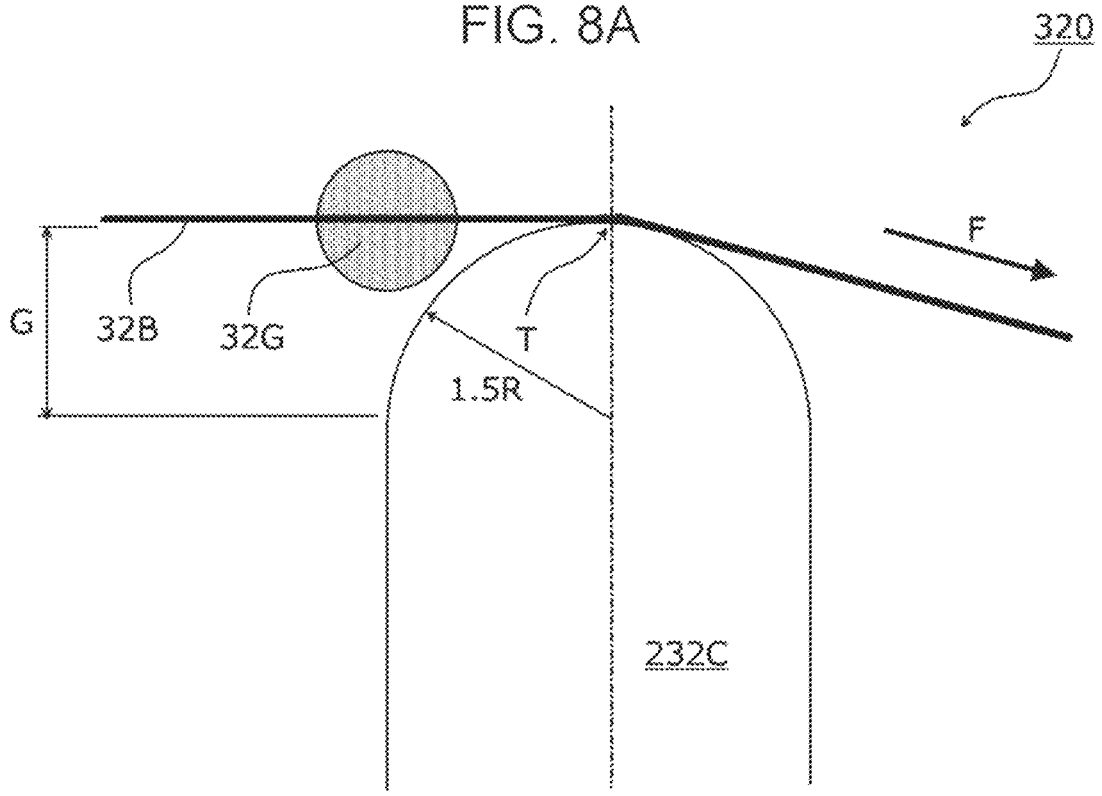
FIGS. 8A and 8B are schematic sectional views illustrating a corona wire stretched in a charging device according to a second exemplary embodiment.
Figure 8B:
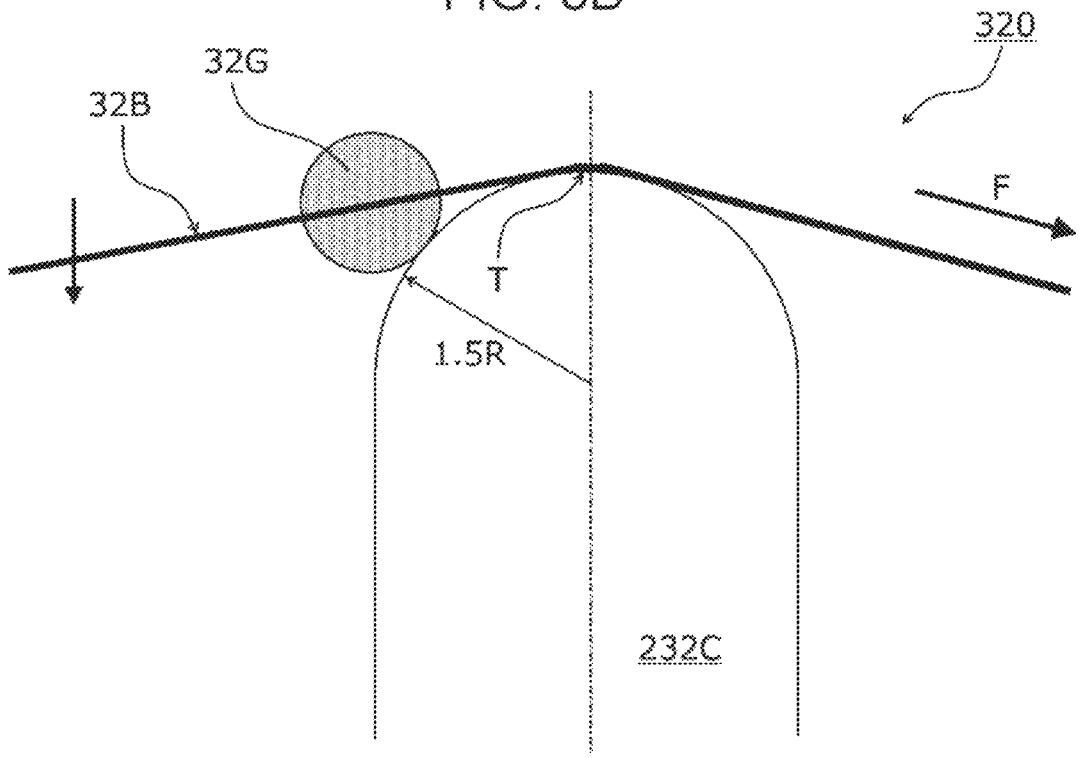

FIGS. 8A and 8B are schematic sectional views illustrating the corona wire 32B stretched in a charging device 320 according to a second exemplary embodiment.

The charging device 320 includes, as with the charging device 32 according to the first exemplary embodiment, the shielding case 32A, the corona wires 32B, the insulating blocks 32C and 32D provided at the respective ends of the shielding case 32A and holding the corona wire 32B in a stretched state, and the grid electrode 32E provided on the open side of the shielding case 32A and between the corona wire 32B and the photoconductor drum 31. The charging device 320 includes an elastic member 32G provided on the corona wire 32B.

Referring to FIG. 8A, the elastic member 32G is provided on the corona wire 32B in such a manner as to be positioned in the gap G produced between the positioning portion 232C and the corona wire 32B supported at the vertex T of the positioning portion 232C standing in the insulating block 32C, the gap G spreading in the corona-wire-stretching direction.

The material for the elastic member 32G may be a silicone resin material or a rubber material, as with the case of the elastic member 32F according to the first exemplary embodiment. Specifically, the silicone resin material may be methyl silicone rubber or the like. The rubber material may be synthetic rubber such as nitrile-butadiene rubber (NBR), silicone rubber, or fluorocarbon rubber (FPM); or a rubber-like elastic material such as thermoplastic elastomer obtained by mixing polypropylene (PP) and ethylene propylene rubber (EPDM).

Referring to FIG. 8B, in the charging device 320 employing the elastic member 32G provided on the corona wire 32B, when the corona wire 32B vibrates with the vertex T of the positioning portion 232C as the support and moves down toward the positioning portion 232C, the elastic member 32G provided on the corona wire 32B comes into contact with the positioning portion 232C.

Therefore, the amplitude of vibration of the corona wire 32B in the gap G becomes small, whereby the vibration of the corona wire 32B is suppressed. Consequently, the occurrence of an image defect is suppressed.

Modification

Figure 9A:
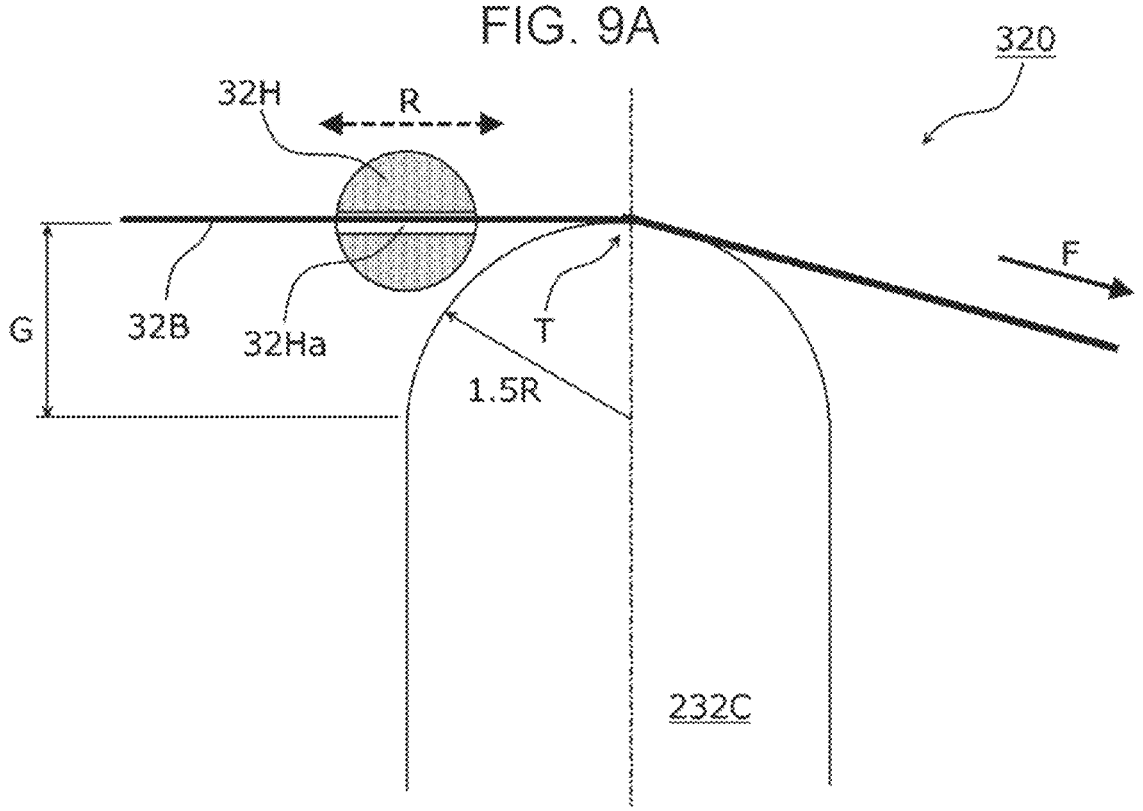
FIGS. 9A and 9B are schematic sectional views illustrating a corona wire stretched in a charging device according to a modification of the second exemplary embodiment.
Figure 9B:
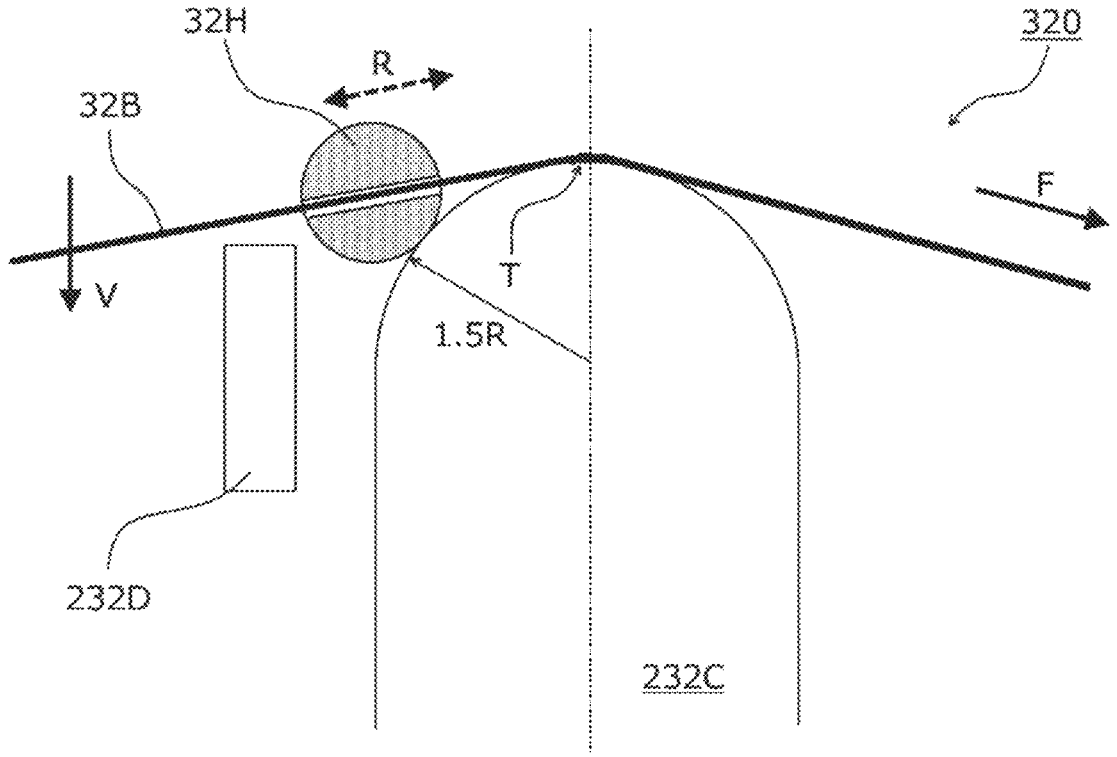

FIGS. 9A and 9B are schematic sectional views illustrating the corona wire 32B stretched in a charging device 320 according to a modification of the second exemplary embodiment.

In the charging device 320 according to the modification, an elastic member 32H is provided on the corona wire 32B in such a manner as to be movable in the corona-wire-stretching direction (as represented by double-headed arrow R in FIGS. 9A and 9B). Furthermore, the insulating block 32C is provided with a restricting portion 232D that restricts the movement of the elastic member 32H when the elastic member 32H moves in the corona-wire-stretching direction and comes into contact with the elastic member 32H.

As illustrated in FIGS. 9A and 9B, the elastic member 32H generally has a spherical shape with a through hole 32Ha provided therein. The corona wire 32B movably extends through the through hole 32Ha. The corona wire 32B has a diameter of 60 μm. Therefore, if the through hole 32Ha has a diameter of 100 μm to 200 μm, the elastic member 32H is movable along the corona wire 32B.

The elastic member 32H according to the second exemplary embodiment is formed by applying a certain amount of liquid-state methyl silicone rubber to the corona wire 32B stretched between the insulating blocks 32C and 32D, and curing the methyl silicone rubber. Thus, the elastic member 32H contracts and is released from the corona wire 32B. Hence, the elastic member 32H becomes movable on the corona wire 32B.

Alternatively, a rubber-like elastic material, for example, synthetic rubber such as nitrile-butadiene rubber (NBR), silicone rubber, or fluorocarbon rubber (FPM); or thermoplastic elastomer obtained by mixing polypropylene (PP) and ethylene propylene rubber (EPDM) may be shaped into a hollow body so as to be attached to the corona wire 32B.

In the charging device 320 employing the elastic member 32H provided on the corona wire 32B in such a manner as to be movable in the corona-wire-stretching direction, referring to FIG. 9B, when the corona wire 32B vibrates with the vertex T of the positioning portion 232C as the support and moves down toward the positioning portion 232C (as represented by arrow V in FIG. 9B), the elastic member 32H provided on the corona wire 32B comes into contact with the positioning portion 232C. Since the elastic member 32H provided on the corona wire 32B is movable in the corona-wire-stretching direction, when the corona wire 32B vibrates vertically, the elastic member 32H is more likely to come into contact with the positioning portion 232C. Therefore, the vibration of the corona wire 32B in the gap G is suppressed more assuredly.

While some exemplary embodiments of the present disclosure have been described with several specific examples, the technical scope of the present disclosure is not limited to the above exemplary embodiments. Various changes may be made to the above exemplary embodiments without departing from the essence of the present disclosure.

For example, while the above exemplary embodiments each concern a case where the elastic member 32F, 32G, or 32H is provided on the side of the insulating block 32C, another elastic member may be added on the side of the insulating block 32D on which the extension spring S is not provided. In that case, the vibration of the corona wire 32B is suppressed more effectively.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging device comprising:

a housing;

a corona wire stretched in the housing; and a positioning member supporting the corona wire and determining a distance between the corona wire and a photoconductor, the positioning member being provided at an end of the housing, wherein the positioning member has a vertex extending in a direction intersecting a corona-wire-stretching direction in which the corona wire is stretched, and wherein an elastic member is provided in a gap between the positioning member and the corona wire supported at the vertex, and wherein the elastic member is configured to be pressed directly against the positioning member by vibration of the corona wire.

2. The charging device according to claim 1, wherein the positioning member has a curved top surface in sectional view taken in the corona-wire-stretching direction, and the vertex is at a center of the top surface in the corona-wire-stretching direction.

3. The charging device according to claim 2, wherein the elastic member is provided over the corona wire supported at the vertex, in such a manner as to cover the top surface of the positioning member.

4. The charging device according to claim 3, wherein the elastic member is made of a silicone resin material or a rubber material.

5. The charging device according to claim 2, wherein the elastic member is made of a silicone resin material or a rubber material.

6. The charging device according to claim 1, wherein the positioning member has a curved top surface in sectional view taken in the corona-Wire-stretching direction.

7. The charging device according to claim 6, wherein the elastic member is provided over the corona wire supported at the vertex, in such a manner as to cover the top surface of the positioning member.

8. The charging device according to claim 7, wherein the elastic member is made of a silicone resin material or a rubber material.

9. The charging device according to claim 6, wherein the elastic member is made of a silicone resin material or a rubber material.

10. The charging device according to claim 1, wherein the positioning member has a top surface including a curved portion and a vertically inclined portion in sectional view taken in the corona-wire-stretching direction.

11. The charging device according to claim 10, wherein the elastic member is provided over the corona wire supported at the vertex, in such a manner as to cover the top surface of the positioning member.

12. The charging device according to claim 10, wherein the elastic member is made of a silicone resin material or a rubber material.

13. The charging device according to claim 1, wherein the elastic member is provided over the corona wire supported at the vertex, in such a manner as to cover the top surface of the positioning member.

14. The charging device according to claim 13, wherein the elastic member is made of a silicone resin material or a rubber material.

15. The charging device according to claim 1, wherein the elastic member is made of a silicone resin material or a rubber material.

16. An image forming apparatus comprising:

an image forming device that forms a multilayer toner image including a plurality of toner images in different colors by using toners having the respective colors, the image forming device including the charging device according to claim 1.

17. A charging device comprising:

a housing;

a corona wire stretched in the housing; and a positioning member supporting the corona wire and determining a distance between the corona wire and a photoconductor, the positioning member being provided at an end of the housing, wherein the positioning member has a vertex extending in a direction intersecting a corona-wire-stretching direction in which the corona wire is stretched, wherein an elastic member is provided on the corona wire in such a manner as to be positioned in a gap between the positioning member and the corona wire supported at the vertex, and, wherein the elastic member is configured to be pressed directly against the positioning member by vibration of the corona wire.

18. The charging device according to claim 17, wherein part of the elastic member comes into contact with the positioning member when the corona wire vibrates.

19. The charging device according to claim 17, wherein the elastic member is movable on the corona wire, and wherein the charging device further includes a restricting member that restricts the movement of the elastic member when the elastic member moves in the corona-wire-stretching direction and comes into contact with the elastic member.

20. A charging device comprising:

a housing;

a corona wire stretched in the housing; and a positioning member supporting the corona wire and determining a distance between the corona wire and a photoconductor, the positioning member being provided at an end of the housing, wherein the positioning member has a vertex extending in a direction intersecting a corona-wire-stretching direction in which the corona wire is stretched, wherein an elastic member is provided in a gap between the positioning member and the corona wire supported at the vertex, and wherein the elastic member is provided over the corona wire supported at the vertex, in such a manner as to cover the top surface of the positioning member.

* * * * *